United States Patent [19]

Pietinen et al.

[11] Patent Number: 5,016,824

[45] Date of Patent: May 21, 1991

[54] METHOD AND APPARATUS FOR CONTROLLING THE PRODUCTION OF THERMOMECHANICAL PULP

[76] Inventors: Pertti Pietinen, Korpikuja 31 as 10, 87200 Kajaani; Aslak Savonjousi, Vanha Rastalantie 10, 02620 Espoo, both of Finland

[21] Appl. No.: 457,723

[22] PCT Filed: Jul. 15, 1988

[86] PCT No.: PCT/FI88/00118

§ 371 Date: Jan. 10, 1990

§ 102(e) Date: Jan. 10, 1990

[87] PCT Pub. No.: WO89/00624

PCT Pub. Date: Jan. 26, 1989

[30] Foreign Application Priority Data

Jul. 15, 1987 [FI] Finland ..... 873120

[51] Int. Cl.[5] ..... B02C 25/00

[52] U.S. Cl. ..... 241/21; 241/28; 241/29; 241/34; 241/42; 241/161

[58] Field of Search ..... 162/258; 241/28, 30, 241/21, 34, 38, 246, 247, 29, 42, 161, 162, 163

[56] References Cited

U.S. PATENT DOCUMENTS 2,437,715 3/1948 Thorp et al. ..... 162/258
2,880,654 4/1959 Henry ..... 241/34 X
3,092,338 6/1963 Reinhall ..... 241/28 X
3,617,006 11/1971 Jones ..... 241/28 X
4,037,792 7/1977 Peterson ..... 241/28 X
4,148,439 4/1979 Floden ..... 241/28

*Primary Examiner*—Mark Rosenbaum

[57] ABSTRACT

Method and an apparatus for controlling the production of thermomechanical pulp meter chips by metering elements (9, 10) into a feed chest (2), and by feed elements (3, 7) connected to the feed chest feeds chips for refinement between thermomechanical pulp refining discs (5). Water is added to the chips prior to feeding the chips between the discs (5). Moisture content of the thermomechanical pulp is measured after the thermomechanical pulp refiner at least in a semicontinuous fashion by at least one measurement device (21, 22, 23, 24) operating on-line, and on the basis of measured moisture content, the quantity of chips and water to be metered is controlled so as to regulate the moisture content to a desired level of having a constant value by, e.g., increasing the volume of metered chips and simultaneously decreasing the quantity of fed water for an increasing trend of moisture content, and correspondingly, applying an opposite strategy to counter a decreasing trend of moisture content. The implementation provides for a consistent quality of thermomechanical pulp.

14 Claims, 5 Drawing Sheets

METHOD AND APPARATUS FOR CONTROLLING THE PRODUCTION OF THERMOMECHANICAL PULP

FIELD OF THE INVENTION

The present invention relates to a method for controlling the production of thermomechanical pulp.

The invention also concerns an apparatus for the implementation of the method.

DESCRIPTION OF THE BACKGROUND ART

In prior art methods, the feed of chips to the rotating thermomechanical pulp refiner was under manual control of set values for chip entry and water feed. In the manual control method, control delay of some process set values is naturally extremely long, typically in the order of several hours. The selection of set values is approximate and inconsistent. Furthermore, since the density and size variation of entering chips is random, this method is incapable of producing a consistent quality of thermomechanical pulp.

Efforts have been made to estimate the water quantity of the chips entering the refiner, but approaches to a reliable moisture content sensor for chips have been unsuccessful.

Also, adjustable systems are known in the art, in which an attempt has been made to maintain power consumed by the refiner constant by regulating the quantity of fed water. Yet, although the power input from the mains to the thermomechanical pulp refiner is maintained constant, thermomechanical pulp presents deviations due to variations in density of chips.

Water feed is also controlled by first measuring the freeness value of thermomechanical pulp which gives a standardized measure for pulp drainage and is characteristic of the fines of thermomechanical pulp, and then, on the basis of determined freeness, adjusting water quantity, production capacity, and disc clearance to obtain desired freeness value. This method, however, is insensitive to changes in consistency and density. In addition, freeness measurement is time consuming, and consequently, does not lend to real-time control, but rather presents an appreciable delay between the time of measurement to that of control.

SUMMARY OF THE INVENTION

The aim of the present invention is to overcome the disadvantages associated with the prior art technology and achieve a totally new kind of method and apparatus for controlling the production of thermomechanical pulp.

The invention is based on measuring in a continuous manner the moisture content of thermomechanical pulp emerging from the refiner so as to use the measured value for controlling the ratio of additional water to volume of fed chips to a desired level.

More specifically, the method in accordance with the invention is characterized by metering chips to a feed chest, transferring the chips from a feed chest to refiner discs and adding water prior to feeding the chips between the refiner discs.

Furthermore, the apparatus in accordance with the invention is characterized by metering means for metering chips into a refiner, feeder means for feeding the chips to refiner discs and water metering means for feeding water to the chips prior to feeding the chips between the refiner discs.

The invention provides outstanding benefits.

With the help of moisture content measurements of thermomechanical pulp, disturbance created by variations in moisture content can be eliminated. As the moisture content is under control, the production machinery can be run at higher capacity resulting in an increase in efficiency.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is next examined in detail with the help of the following exemplifying embodiment illustrated in the attached drawings which are given by way of illustration only, and thus are not limitative of the present invention and wherein.

DETAILED DESCRIPTION OF THE PREFERRED EMBODIMENTS

Figure 1:
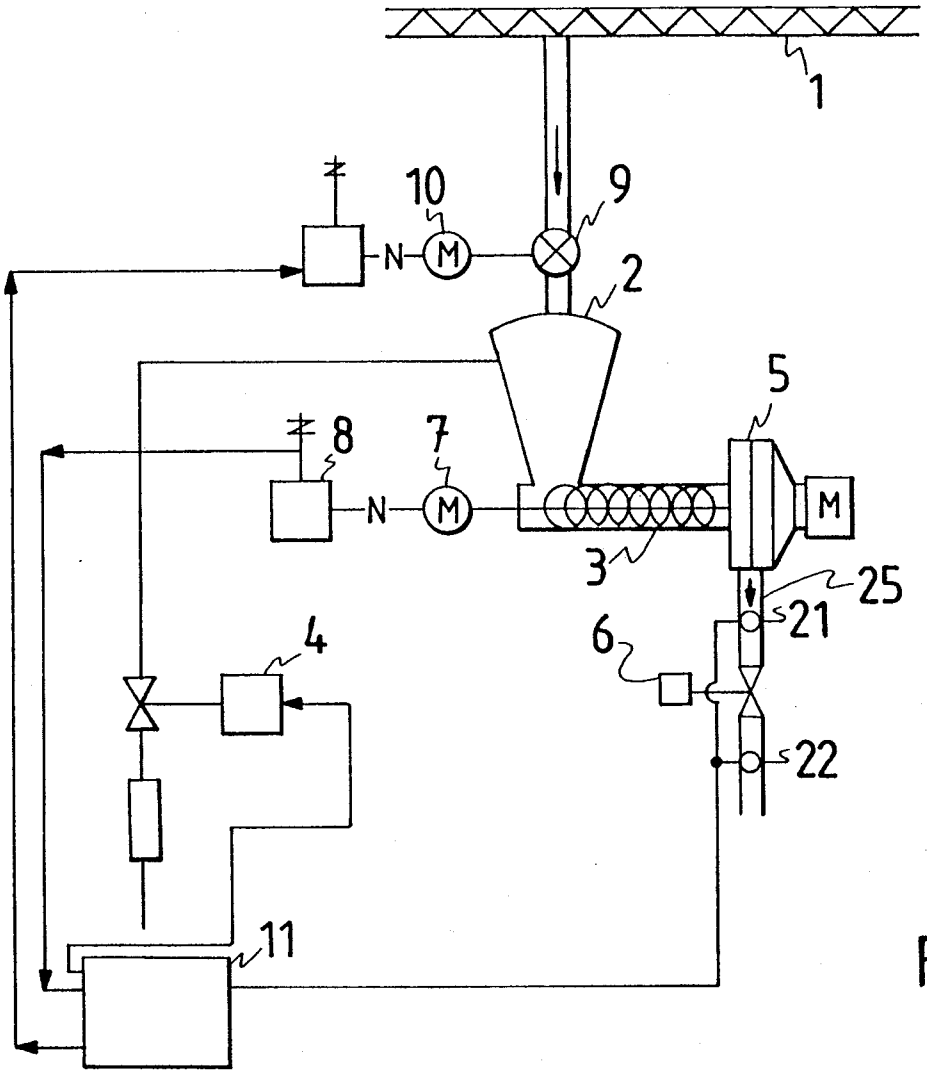
FIG. 1 shows diagrammatically a control system in accordance with the present invention.

According to FIG. 1, wood chips to be refined are conveyed to the thermomechanical pulp refinery by conveyor 1. The chips are fed and metered with the help of a feeder 9 rotated by a motor 10 to a feed chest 2 of the thermomechanical pulp refiner, from where the chips are further fed into the gap between the refining discs 5 by a feeder auger 3 rotated by a feeder motor 7. In the feed chest 2 or within the auger tube 3, water is added by a volume regulated by a controller 4. Between the discs 5, the chips are ground into thermomechanical pulp, and the generated steam expels stock forward via a control valve 6. The purpose of the control valve 6 is to maintain a constant steam pressure. After the discs 5, prior to the valve 6, a moisture sensor 21 for thermomechanical pulp is arranged in the outlet pipe 25. A corresponding sensor 22 may also be placed on the route of the thermomechanical pulp after the control valve 6. The obtained moisture signal is taken to the controller 4 or to a data processing unit 11. If the moisture of thermomechanical pulp falls below a desired set value, water volume in the chips is increased by either reducing feed rate of chips or increasing volume of added water using a conventional control method. For an excessive moisture content, the opposite is true. In practice the control operation takes place by sending a new set value to the controller 4 from the data processing unit 11.

Figure 2:
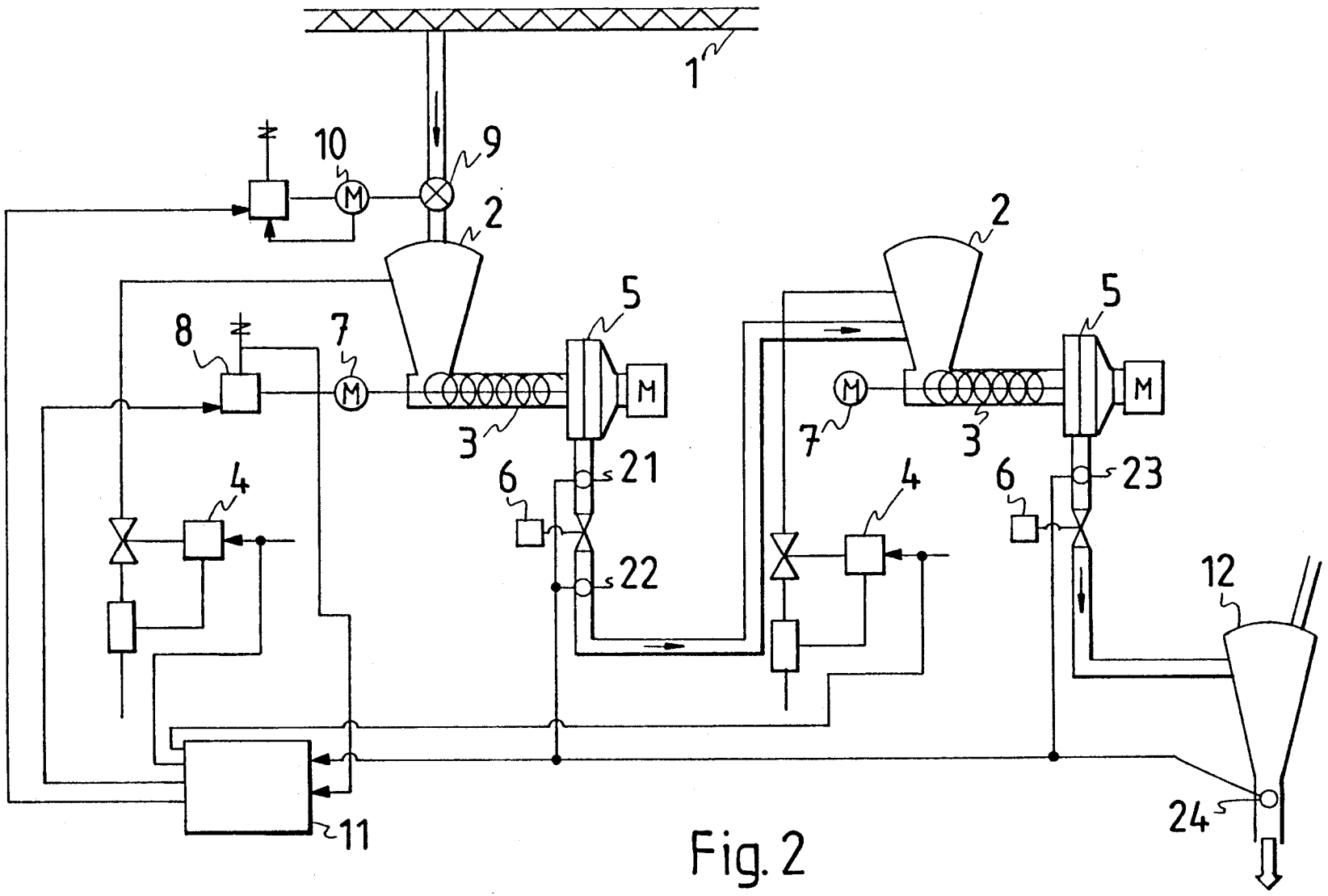
FIG. 2 shows diagrammatically another control system in accordance with the present invention.

According to FIG. 2, two thermomechanical pulp refiners are connected in tandem. However, the number of moisture content measurement points is greater. A moisture content sensor 23 may be located in the outlet pipe of the second refiner. A sensor 24 may also be placed to a point after a cyclone 12 in, e.g., the outlet pipe of the cyclone. Each sensor 21, 22, 23, and 24 is advantageously arranged to have independent function and transmission of sensor signals to a data processing unit 11, whereby the signals may either be selected for an optimum singular signal best describing the process or be subjected to a mathematical processing by, e.g., averaging, to obtain a suitable control signal. In some cases a single sensor may be sufficient. Both thermomechanical pulp refiners are provided with identical control equipment 4 for water addition according to the set-up in FIG. 1. The set values for the thermomechanical pulp refiners, however, may be different.

Figure 3:
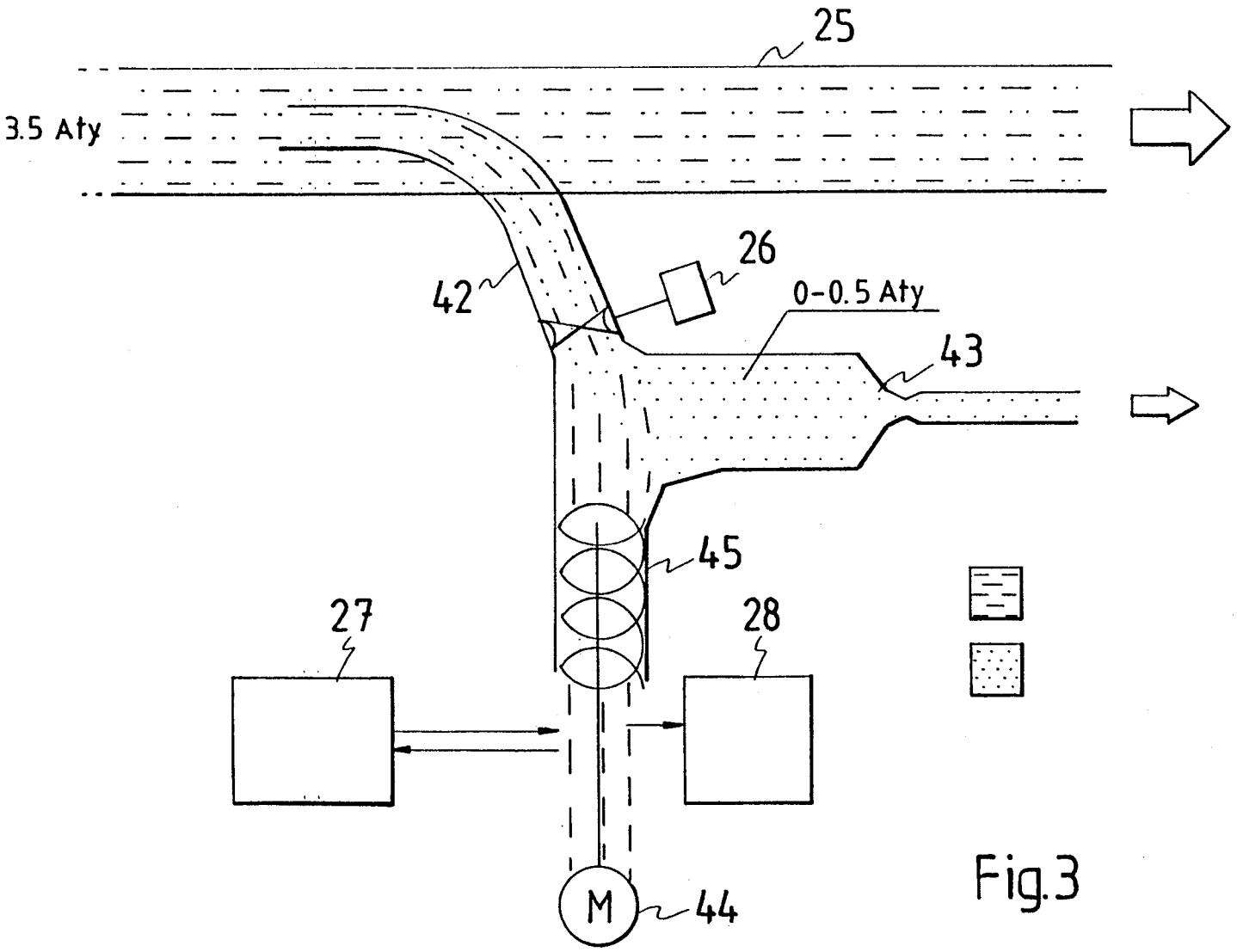
FIG. 3 shows in a partially diagrammatic form a measurement set-up connected to the control system illustrated in FIG. 1.

In FIG. 3, a measurement set-up is attached to an outlet pipe 25 of the thermomechanical pulp refiner allowing a bypass pipe 42 to be configured to the thermomechanical pulp flow. The pipe 42 is provided with a choke valve 26 for controlling the bypass flow. The steam developed by pulp expanding to a larger volume is removed via a condenser 43, and the thermomechanical pulp is transferred by means of an auger 45 rotated by a motor 44 to moisture content sensors 27 and 28. For making nontransmissive infra-red measurements, sensor unit 27 is sufficient. When using microwave measurement, a receiver unit 28 is additionally required.

Figure 4:
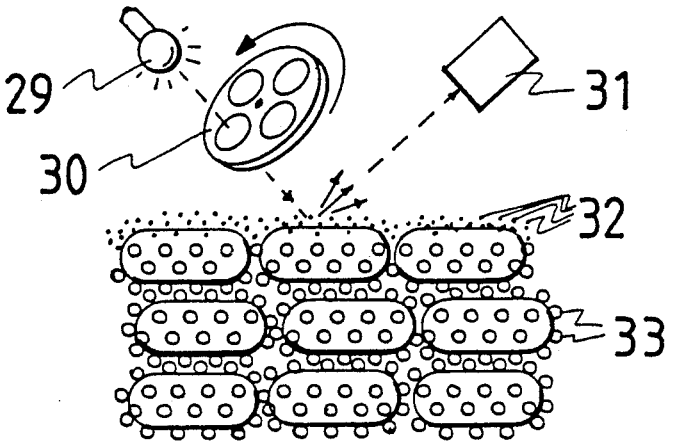
FIG. 4 shows diagrammatically a principle of infra-red measurement.

According to FIG. 4, the infra-red equipment operates by sending IR light from an IR source 29 via a filter disc 30, and the filtered light is dispersed by water molecules 32. The dispersed radiation is detected by a detector 31. Water molecules 33 remaining under the surface escape detection.

Figure 5:
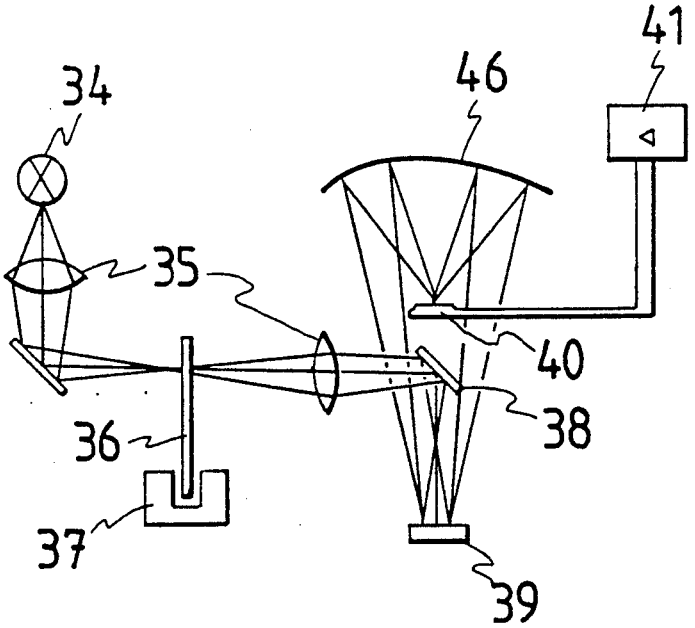
FIG. 5 shows diagrammatically a measurement set-up of infra-red measurement.

In the embodiment illustrated in FIG. 5, light emerging from the IR source 34 is routed via lenses 35 and mirrors through a filter unit 36, and via a mirror 38 to a target 39. The filter unit 36 is provided with a chopper unit 37 for chopping the light beam. Light reflected from the target 39 is routed to a light-dependent resistor 40 acting as an IR detector, and the output signal of the resistor 40 is amplified by an amplifier 41.

Direct measurement of thermomechanical pulp moisture content under pressure is also feasible by mounting a transparent section to the stock pipe. When using the aforedescribed IR measurement, a mere transparent window will suffice.

When using microwave measurement, a sender unit 27 and a receiver unit 28 are located on the opposite sides of the stock pipe. The stock pipe must be of a microwave-transparent material, e.g., teflon, at least for the section used for the microwave measurement.

Figure 6:
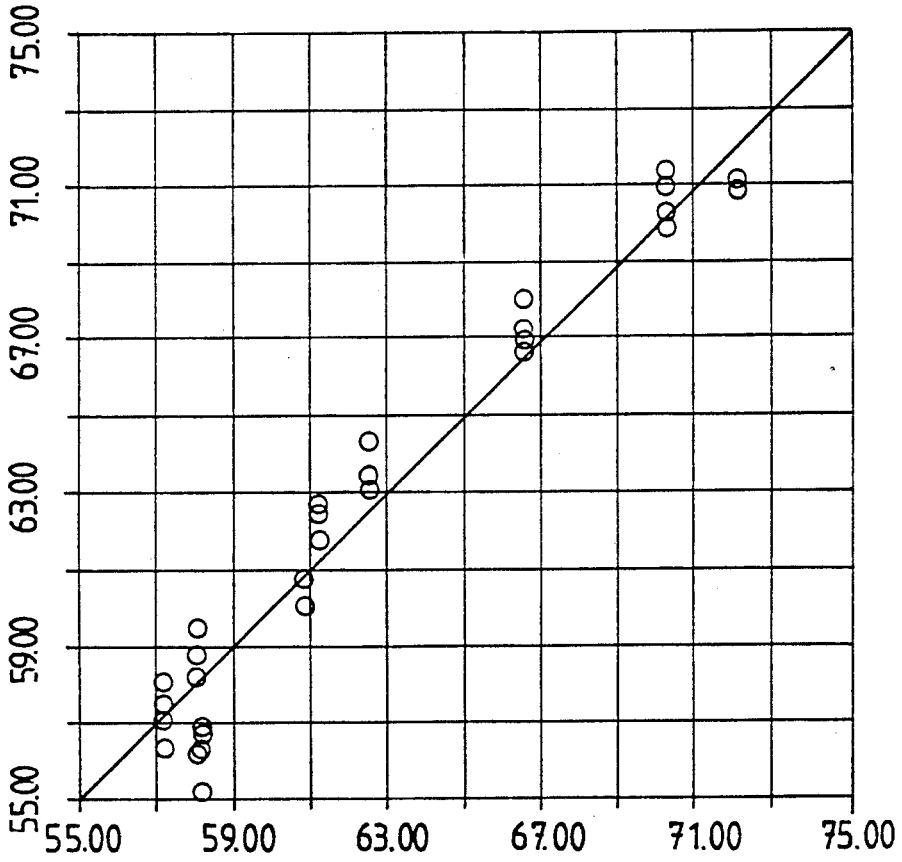
FIG. 6 shows in the form of a graph the correlation of the infra-red measurement method to laboratory verifications.

FIG. 6 illustrates the correlation of moisture content from IR measurements to laboratory verification results. In the moisture content measurement session, the output signal of the moisture content sensor was 2.30 V, the flow rate of additional water was then 85 l/min, and the freeness was 145 CSF. After a change in the moisture of entering chips, the sensor signal was 2.41 V, and the corresponding freeness was 153 CSF. The controller adjusted the rate of water addition to a level of 78 l/min, resulting in the return of the sensor signal to a level of 2.32 while the corresponding freeness was 142 CSF. No major changes were detected by the measurements in the moisture content of chips. Consequently, a direct measurement of moisture content from the chips was unsuccessful, because the sensor measures only the surface moisture of chips.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for controlling a thermomechanical pulp refiner comprising the steps of:

metering chips to a feed chest of the thermomechanical pulp refiner;

transferring the chips by a feeder from the feed chest to thermomechanical pulp refiner discs;

adding water to the chips prior to feeding the chips between the thermomechanical pulp refiner discs;

semicontinuously measuring moisture content of a combination of thermomechanical pulp and steam after the thermomechanical pulp refiner by at least one IR-reflection measurement device; and controlling on a basis of measured moisture content a quantity of chips during the step of metering and a quantity of water during the step of adding in order to regulate the moisture content to a desired level having a generally constant value, the step of controlling further comprising at least one of the following steps:

(A) for an increasing trend in moisture content, implementing one of the following steps:
increasing volume of metered chips,
decreasing the quantity of fed water, and
increasing the volume of metered chips and decreasing the quantity of fed water; and (B) for a decreasing trend in moisture content, implementing one of the following steps:
decreasing the volume of metered chips,
increasing the quantity of fed water, and
decreasing the volume of metered chips and increasing the quantity of fed water.

2. The method in accordance with claim 1, further comprising the step of providing a pipe with a transparent pipe section at an exit of the thermomechanical pulp refiner and wherein the step of measuring moisture content uses the transparent pipe section and infrared measurement.

3. The method in accordance with claim 1, further comprising the steps of:

maintaining a generally constant pressure level of steam in the refiner by using a control valve; and propelling refined stock forward from the refiner disks by the steam.

4. The method in accordance with claim 3, further comprising the step of providing a sensor in at least one of two positions, a first one of the two positions being between an outlet from the thermomechanical pulp refiner discs and the control valve and a second one of the two positions being downstream from the control valve, the sensor being used in the step of measuring.

5. The method in accordance with claim 3, wherein a second thermomechanical pulp refiner is provided in tandem with the first-discussed thermomechanical pulp refiner, the second thermomechanical pulp refiner having a second feed chest connected to second thermomechanical pulp refiner discs by a second feeder, the method further comprising the steps of:

feeding output from the first thermomechanical pulp refiner to the second feed chest;

transferring the output from the second feed chest to the second refiner discs;

adding water to the output prior to feeding the output to the second refiner discs;

measuring moisture content of output from the second refiner discs; and controlling on a basis of the measured moisture content of the output from the second refiner discs at least a quantity of water during the step of adding prior to the second refiner discs.

6. The method in accordance with claim 5, further comprising the steps of:

providing a second control valve downstream of the second refiner discs; and locating a second sensor in at least one of two positions, a first one of the two positions being between an outlet from the second thermomechanical pulp refiner discs and the second control valve and a second one of the two positions being downstream from the control valve, the second sensor being used in the step of measuring moisture content of the output from the second refiner discs.

7. The method in accordance with claim 1, wherein a second thermomechanical pulp refiner is provided in tandem with the first-discussed thermomechanical pulp refiner, the second thermomechanical pulp refiner having a second feed chest connected to second thermomechanical pulp refiner discs by a second feeder, the method further comprising the steps of:

feeding output from the first thermomechanical pulp refiner to the second feed chest;

transferring the output from the second feed chest to the second refiner discs;

adding water to the output prior to feeding the output to the second refiner discs;

measuring moisture content of output from the second refiner discs; and controlling on a basis of the measured moisture content of the output from the second refiner discs at least a quantity of water during the step of adding prior to the second refiner discs.

8. An apparatus for controlling a refiner, comprising:

chip metering means for metering chips to a thermomechanical pulp refiner;

feeder means for feeding metered chips to thermomechanical pulp refiner discs in order for the chips to be refined;

water metering means for feeding water to the chips prior to feeding the chips into the thermomechanical pulp refiner discs;

IR-reflection moisture content measuring elements, said elements being arranged along a passage for thermomechanical pulp downstream of the refiner discs, said elements determining moisture content of a combination of thermomechanical pulp and steam; and control means for controlling the metering means, the feeder means and the water metering means in response to moisture content values received from the measuring elements to maintain a generally constant moisture content of thermomechanical pulp.

9. The apparatus in accordance with claim 8, further comprising a pipe connected to an outlet of the thermomechanical pulp refiner discs, said pipe having a transparent section and at least some of the measuring elements being located adjacent said transparent section.

10. The apparatus in accordance with claim 8, further comprising:

a pipe connected to an outlet of the thermomechanical pulp refiner discs for receiving output from the refiner discs; and a valve provided in said pipe for maintaining a generally constant pressure level of steam in the refiner.

11. The apparatus in accordance with claim 10, wherein at least one of the measuring elements is located in one of two positions, a first one of the two positions being between the outlet of the refiner discs and the valve and a second one of the two positions being downstream from the valve.

12. The apparatus in accordance with claim 10, further comprising a second thermomechanical pulp refiner in tandem with the first-discussed thermomechanical pulp refiner, the second thermomechanical pulp refiner having:

means for connecting an outlet of the refiner discs to the second thermomechanical pulp refiner;

second chip feeder means for feeding output from the refiner discs of the first thermomechanical pulp refiner through the means for connecting to second thermomechanical pulp refiner discs;

second water metering means for feeding water to the output prior to feeding the output into the second thermomechanical refiner discs; and second elements for measuring moisture content of output from the second pulp refiner discs, the control means controlling the second chip feeder means and the second water metering means in response to the measured moisture content of the output from the second refiner discs.

13. The apparatus in accordance with claim 12, further comprising a second valve provided downstream of the second refiner discs, the second elements being located in at least one of two positions, a first one of the two positions being between an outlet from the second thermomechanical pulp refiner discs and the second valve and a second one of the two positions being downstream from the second valve.

14. The apparatus in accordance with claim 8, further comprising a second thermomechanical pulp refiner in tandem with the first-discussed thermomechanical pulp refiner, the second thermomechanical pulp refiner having:

means for connecting an outlet of the refiner discs to the second thermomechanical pulp refiner;

second chip feeder means for feeding output from the refiner discs of the first thermomechanical pulp refiner through the means for connecting to second thermomechanical pulp refiner discs;

second water metering means for feeding water to the output prior to feeding the output into the second thermomechanical refiner discs; and second elements for measuring moisture content of output from the second pulp refiner discs, the control means controlling the second chip feeder means and the second water metering means in response to the measured moisture content of the output from the second refiner discs.

* * * * *